United States Patent [19]

Paulsson

[11] Patent Number: 4,475,758

[45] Date of Patent: Oct. 9, 1984

[54] LIFTING FORK

[76] Inventor: Hjalmar Paulsson, Pl. 1412, S-450 63 Högsäter, Sweden

[21] Appl. No.: 372,433

[22] Filed: Apr. 27, 1982

[30] Foreign Application Priority Data

Apr. 27, 1981 [SE] Sweden ..... 8102640

[51] Int. Cl.[3] ..... B66C 1/24

[52] U.S. Cl. ..... 294/67 AA; 294/63 R; 414/639; 414/645

[58] Field of Search ..... 294/67 R, 67 A, 67 AA, 294/67 AB, 63 R, 78 R, 78 A, 82 R, 83 R, 86 LS, 122–124; 414/639, 645, 647, 662

[56] References Cited

U.S. PATENT DOCUMENTS

| | | | |
|---|---|---|---|
| 872,651 | 12/1907 | Gordon | 294/122 X |
| 993,145 | 5/1911 | Bradley . | |
| 1,564,652 | 12/1925 | Wallace . | |
| 1,745,839 | 2/1930 | Wallace | 294/63 R |
| 1,765,765 | 6/1930 | Luce | 294/63 R |
| 1,811,429 | 6/1931 | Fontaine | 294/63 R |
| 1,818,728 | 8/1931 | Mallery et al. | 294/63 R |
| 2,133,557 | 10/1938 | McNeillie . | |
| 2,849,253 | 8/1958 | Bopp | 294/63 R |
| 2,918,322 | 12/1959 | Bopp . | |
| 3,165,344 | 12/1965 | Holder . | |

FOREIGN PATENT DOCUMENTS

| | | | |
|---|---|---|---|
| 326270 | 7/1970 | Sweden . | |
| 275310 | 8/1927 | United Kingdom . | |
| 180778 | 9/1966 | U.S.S.R. | 294/67 A |

*Primary Examiner*—Johnny D. Cherry
*Attorney, Agent, or Firm*—Cushman, Darby & Cushman

[57] ABSTRACT

A lifting fork intended to be suspended from a lifting member, e.g. a lifting hook (4) of a hoisting crane, and which includes forks (2), a lifting shank (3) to which a movable attachment (7,11,14) for the lifting hook (4) is attached, and a connecting bar (5) extending between the forks and the lifting shank. In order to facilitate the withdrawal of the forks (2) from the load the point of action of the lifting force at the lifting fork by moving the attachment (7,11,14) is movable from the position at the lifting shank (3) to a position close to the rear end of the forks (2). This can be achieved in many ways, i.e. by means of the attachment (7,11,14) being displaceable from the lifting shank (3) down along the connecting bar (5) or by the connecting bar (5) or a part thereof possibly together with the lifting shank being pivotable backwards - downwards.

2 Claims, 9 Drawing Figures

FIG. 1
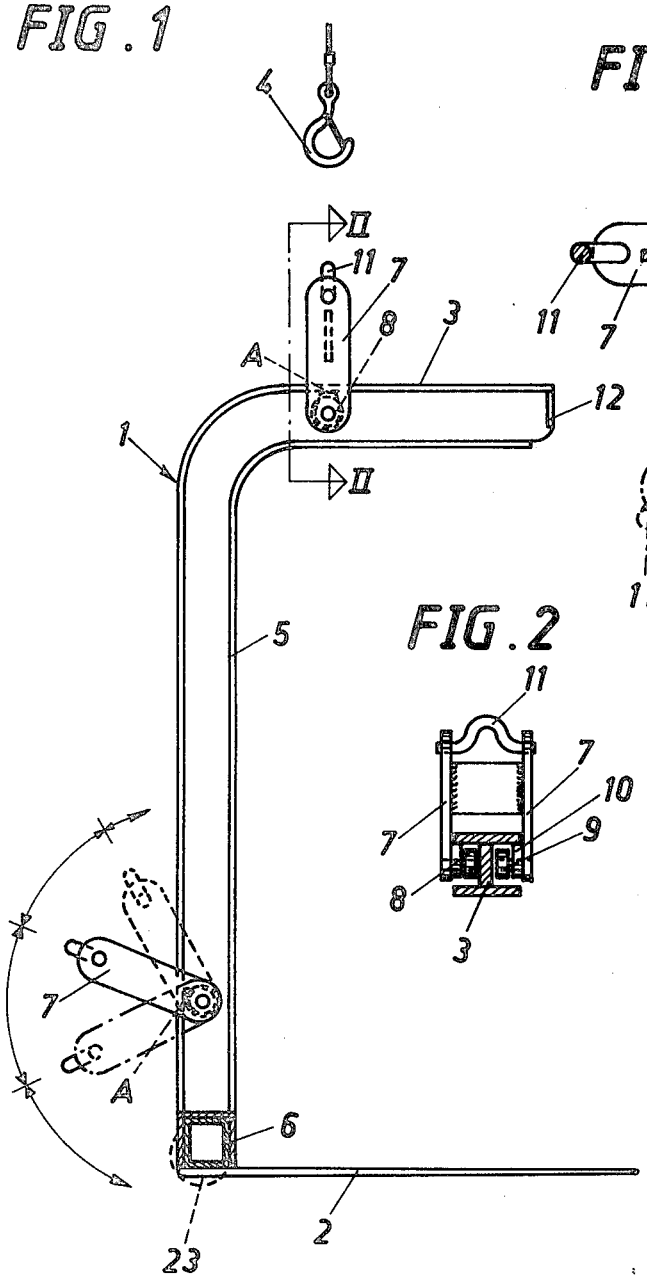
FIG. 3
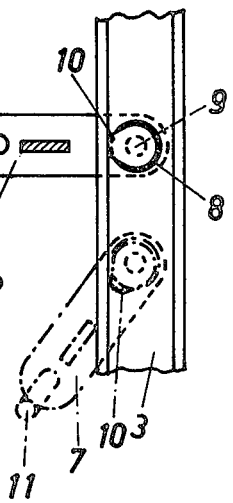
FIG. 2

2
3
4
5
6
13
14
15
16
17
18
19
20
21
22
23
A

LIFTING FORK

BACKGROUND OF THE INVENTION

The present invention refers to a lifting fork adapted to be suspended from a lifting member and which is substantially U-shaped, where the forks make one shank of the U while the other shank, the lifting shank, is adapted to receive a movable attachment means for the lifting member for transmitting a lifting force to the lifting fork.

The lifting member, e.g. a lifting hook of a hoisting crane, can be attached to a loop or the like, which usually is displaceable along the lifting shank of the lifting fork for adjusting the point of action of the lifting member to the centre of gravity of the lifting fork in empty and loaded condition resp. The lifting fork will in this way be self-balancing and the shanks can be kept substantially horizontal in empty as well as in loaded condition, which facilitates the insertion of the shanks under the load and prevents the load from slipping off the shanks.

However, a problem at all lifting forks of this kind known so far is difficulties to withdraw the forks from the load by means of the power from the hoisting crane, especially when the forks are jammed under the load which occurs rather often. The reason for these difficulties is of course that the point of action of the force is located at the lifting shank and not at the forks.

SUMMARY AND ADVANTAGES OF THE INVENTION

The object of the invention is to avoid the above difficulties and to provide a lifting fork, the forks of which easily can be withdrawn from the load by means of the force from the hoisting crane even if the forks are jammed, e.g owing to that the ground is uneven.

This has according to the invention been achieved by the fact that the point of action of the lifting force at the lifting fork by moving said attachment means is movable from said position at the lifting shank to a position close to the rear end of the forks for facilitating the withdrawal of the forks from the load.

DESCRIPTION OF THE DRAWINGS

The invention will now be described more in detail with reference to some embodiments shown in the accompanying drawings.

FIG. 1 is a vertical section through a first embodiment of a lifting fork according to the invention.

FIG. 2 is a section according to the line II—II of FIG. 1.

FIG. 3 is a vertical section through a portion of the lifting whank showing the attachment means for the lifting member in two different positions.

DESCRIPTION OF SOME EMBODIMENTS

Figures 4, 5:
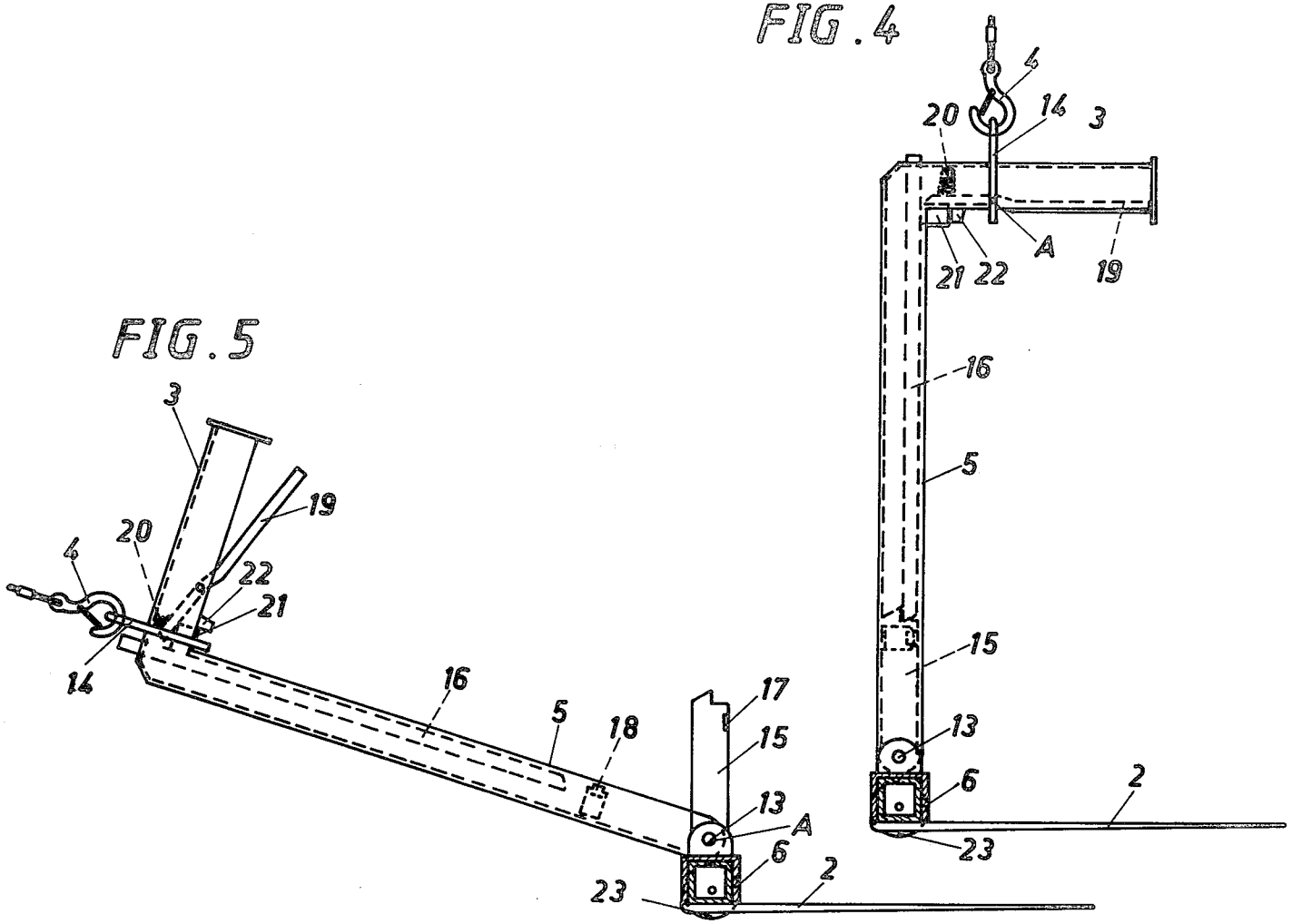
FIG. 4 is a vertical section through a second embodiment in lifting position.
FIG. 5 shows the embodiment of FIG. 4 in a position to be withdrawn from the load.

The lifting fork 1 which is mainly used for goods loaded on loading stools is substantially U-shaped as seen from the side, the forks 2 making one shank of said U and the lifting shank 3 making the other shank. (The structure sometimes referred to herein as "the forks 2" of course is a fork comprising a plurality of tines, e.g. two tines, which are spaced laterally from one another, and a base from which the fork tines project.) The lifting member 4, e.g a hook, is intended to be attached to the lifting shank.

According to the embodiment shown in FIGS. 1 and 2 the intermediate portion of the U viz the connecting bar 5 of the lifting fork 1, and the lifting shank 3 consist of a H-beam bent 90°, which at one end is attached to a square beam 6 extenting across the forks 2 at their rear ends. The forks 2 are attached to said square beam.

A link 7 is displaceable along the H-beam 3,5 on rollers 8 or sliding shoes, said link 7 being provided with an attachment means 11 for the lifting member 4, e.g a hook of a hoisting crane. On each axle 9 of the rollers 8 there is arranged an eccentric 10 with a grooved surface gripping the inside of the lifting shank 3, e.g a grooved steel surface, when the link 7 is in its lifting position, i.e vertical. At other positions of the link 7 the eccentric 10 is released from the lifting shank 3 and the link 7 can be displaced on the rollers 8. The point of action of the lifting force at the lifting fork is denoted A. At the free end of the lifting shank 3 there is preferably arranged a removable stop member 12.

When the lifting fork 1 is lifted empty the link 7 is placed close to the inner end of the lifting shank 3 and when it is lifted loaded close to the outer end of the lifting shank.

The link 7 can freely be displaced from the lifting shank 3 down along the connecting bar 5 to a position close to the forks 2, at which the point of action A of the lifting force is moved to the same position, so that the forks by means of the hoisting crane easily can be withdrawn from the loading stool even if they are jammed.

In FIGS. 4 and 5 there is shown another embodiment of the lifting fork 1, where the connecting bar 5 together with the lifting shank 3 is pivoted at its lower end about an axle 13. The attachment means of the lifting hook 4 consists of a yoke 14 gripping the lifting shank 3 and being displaceable along this.

The connecting bar 5 can in upright position be locked to a locking arm 15, which is fixed to the forks 2 by way of the square beam 6. Locking is provided by means of locking bar 16, which is axially displaceable within the connecting bar 5. Even when the locking bar 16 is retracted the connecting bar 5 is kept upright by means of a snap lock 18 cooperating with a recess 17 in the locking arm 15. A strong jerk backwards is required for pulling the connecting bar 5 out of this position and make it pivot backwards to the position shown in FIG. 4.

The position of the locking bar 16 is controlled by a two-armed lever 19 arranged in the lifting shank 3, the arm of the lever 19 facing the connecting bar 5 being spring-loaded 20 and acting upon a head 21 projecting from the locking bar 16. A shoulder 22 attached to the lifting shank 3 prevents the yoke 14 from being brought against the head 21 of the locking bar 16 by mistake.

When the yoke 14 is in its outer position on the lifting shank 3 and a lifting operation is performed the arm of the lever 19 remote from the connecting bar 5 is pressed upwards and thus the opposite arm is forced downwards and prevents the locking bar 16 from being moved out of its locking position.

In order to move the locking bar 16 out of its locking position the yoke 14 is displaced inwards along the lifting shank 3 past the shoulder 22 and under the head 21, which if a vertical lifting force is applied to the yoke 14 is pressed upwards against the action of the spring 20, at which the locking bar 16 is moved upwards.

When lifting the lifting fork empty the yoke 14 is located somewhere between the two end positions and in such a position the locking bar 16 is maintained in locking position by the spring 20.

When the locking bar 16 has been brought out of locking position the connecting bar 5 can as described above together with the lifting shank 3 be pivoted backwards through an obliquely backwards directed jerk from the hoisting crane to the position shown in FIG. 5, which shows a suitable position for withdrawing the forks from the loading stool, when this is not easily made in another way. The point of action A of the lifting force will in this position be at the axle 13.

Exterior supports for the forks 2 are denoted with 23, said supports can consist of rollers.

Figure 6:
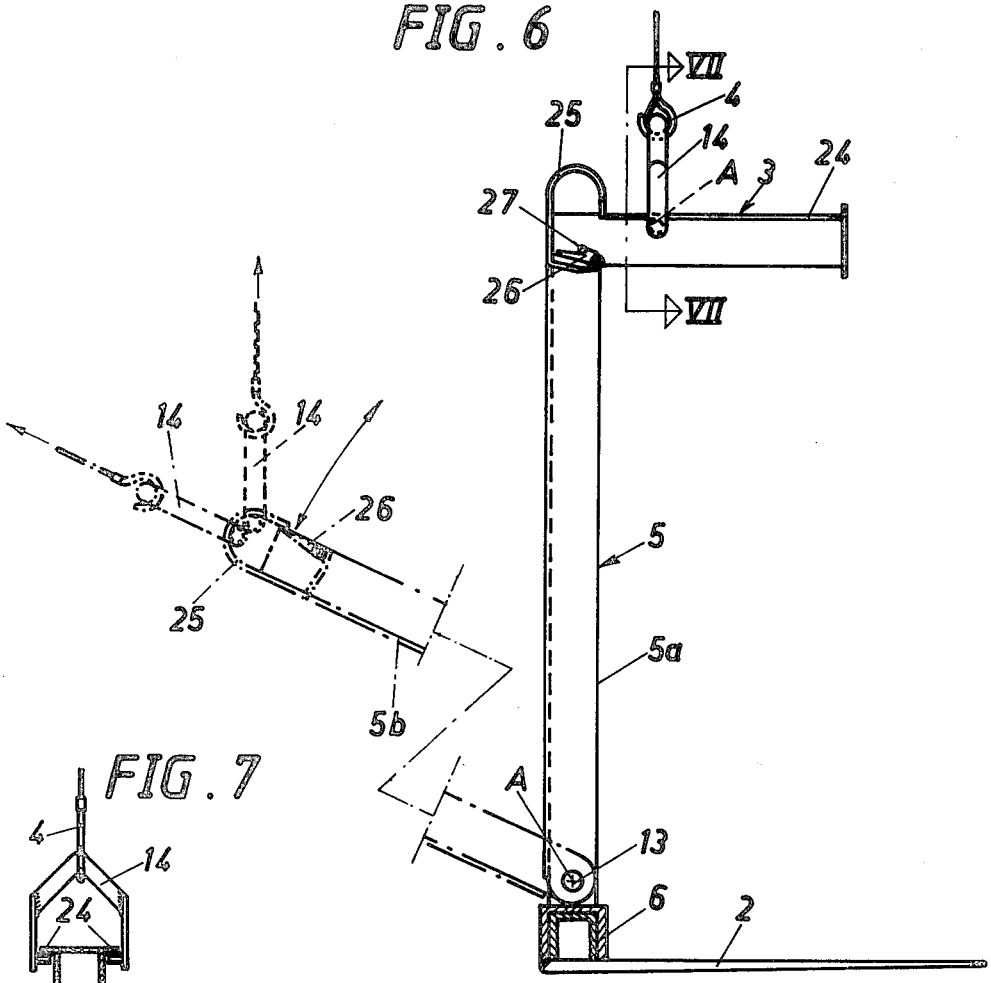
FIG. 6 is a vertical section through a third embodiment.
Figure 7:
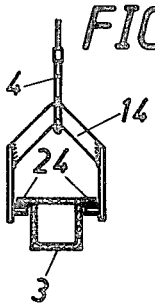
FIG. 7 is a section according to the line VII—VII in FIG. 6.
Figure 8:
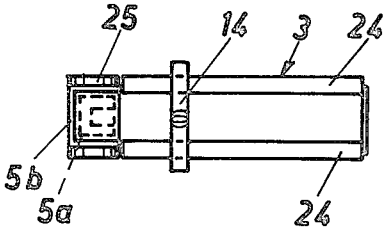
FIG. 8 shows the lifting shank from above.

According to the third embodiment shown in FIGS. 6–9 the connecting bar 5 consists of two parts, a fixed inner box girder 5*a* and an outer U-beam 5*b*, which at its lower end is pivoted about the axle 13 to the position shown with dash dotted lines in FIG. 6. The axle 13 will also in this case be the point of action A of the lifting force when the outer U-beam 5*b* is pivoted backwards to the dash dotted position.

The attachment means for the lifting hook 4 consists of a yoke 14, which is guided along the lifting shank 3 by a pair of flanges 24 projecting therefrom.

Figure 9:
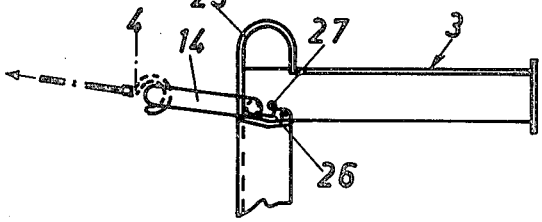
FIG. 9 shows a part of the lifting fork with the lifting member in another position.

The U-beam 5*b* is at its upper end provided with a hook 25 with a spring-loaded pawl 26. The lock is released by means of the yoke 14 when this is brought backwards and somewhat downwards, as is shown in FIG. 9. At the same time the pawl 26 is returned and shuts up the yoke 14 in the hook 25 (shown with dash dotted lines in FIG. 6).

The pawl 26 is forced backwards again when it hits a pin 27 attached to the fixed box firder 5*a* and the pawl engages the pin 27. The yoke 14 can now be brought over to the lifting shank 3.

The invention is of course not limited to the embodiments shown but a number of modifications may be made within the scope of the following claims.

I claim:

1. A lifting fork adapted to be suspended from a lifting member and which is substantially U-shaped, where a multi-tined fork constitutes one shank of the U while the other shank of the U, constituted by a lifting shank, is adapted to receive a movable attachment means for said lifting member, and where the intermediate portion of the U, extending between the two shanks, comprises a connecting bar, said lifting fork further comprising:

an axle arranged transversely to the fork close to the rear end thereof, at least part of said connecting bar being pivoted about said axle from an upright position perpendicular to the fork, to a position behind the fork;

a locking device for locking said part of said connecting bar to said upright position in a locking position of said locking device;

actuating means arranged proximally of the upper end of the connecting bar, said actuating means being arranged to release said locking device out of its locking position upon displacement of said attachment means along the lifting shank into engagement with said actuating means;

said locking device comprising a locking bar extending through the connecting bar and cooperating with a locking arm connected to the rear end of the fork, and said actuating means being connected to the upper part of the locking bar and said attachment means being arranged to cooperate with said actuating means for displacing the locking bar out of engagement with the locking arm.

2. A lifting fork according to claim 1, wherein said locking arm and said connecting bar are provided with cooperating locking members arranged to lock the connecting bar to the locking arm in upright position, said locking members being arranged to be released from each other upon a backwards-directed jerking of the connecting bar.

* * * * *